US009038866B2

(12) United States Patent
Nelson et al.

(10) Patent No.: US 9,038,866 B2
(45) Date of Patent: May 26, 2015

(54) APPLICATION TIPS INCLUDING A DISPENSING NOZZLE WITH ONE OR MORE DISPENSING PASSAGES EXTENDING ALONG A LENGTH THEREOF AND RELATED METHODS

(71) Applicant: Alliant Techsystems Inc., Minneapolis, MN (US)

(72) Inventors: Jacob L. Nelson, Layton, UT (US); Mark A. Sikkink, Layton, UT (US)

(73) Assignee: Orbital ATK, Inc., Dulles, VA (US)

( * ) Notice: Subject to any disclaimer, the term of this patent is extended or adjusted under 35 U.S.C. 154(b) by 0 days.

(21) Appl. No.: 13/797,639

(22) Filed: Mar. 12, 2013

(65) Prior Publication Data

US 2014/0263480 A1 Sep. 18, 2014

(51) Int. Cl.

| | |
|---|---|
| ***B65D 5/72*** | (2006.01) |
| ***B65D 25/40*** | (2006.01) |
| ***B65D 35/38*** | (2006.01) |
| ***B05B 1/14*** | (2006.01) |
| ***B05B 1/00*** | (2006.01) |
| ***A62C 31/02*** | (2006.01) |
| ***B05B 1/26*** | (2006.01) |
| ***B05C 17/005*** | (2006.01) |
| ***B05C 5/02*** | (2006.01) |
| *B05C 7/00* | (2006.01) |

(52) U.S. Cl.

CPC ..... *B05C 17/00513* (2013.01); *B05C 7/00* (2013.01); *B05C 17/00516* (2013.01); *B05C 5/0204* (2013.01)

(58) Field of Classification Search

USPC ..... 222/568, 566; 427/230, 239; 118/317, 118/254, 306, 214, 105, 55; 239/597, 559, 239/567, 558, 271, 272, 568, 598, 601

See application file for complete search history.

(56) References Cited

U.S. PATENT DOCUMENTS

| | | | | |
|---|---|---|---|---|
| 3,397,541 | A * | 8/1968 | Kersh | 405/40 |
| 3,904,718 | A * | 9/1975 | Kuehn, Jr. | 264/39 |
| 4,302,271 | A * | 11/1981 | Injerd | 156/293 |
| 5,010,841 | A | 4/1991 | Stewart | |
| 5,086,953 | A * | 2/1992 | Twede | 222/322 |
| 5,087,484 | A * | 2/1992 | Stewart | 427/239 |
| 2011/0198372 | A1* | 8/2011 | White et al. | 222/482 |

(Continued)

FOREIGN PATENT DOCUMENTS

| | | |
|---|---|---|
| EP | 54631 A1 | 6/1982 |
| EP | 263889 A2 | 4/1988 |

(Continued)

OTHER PUBLICATIONS

Semco Rivet Nozzle Assemblies, http://www.bergdahl.com/PDF_Files/baRivNoz.pdf, Feb. 24, 2005, 2 pages.*

(Continued)

*Primary Examiner* — Patrick M Buechner
*Assistant Examiner* — Benjamin R Shaw
(74) *Attorney, Agent, or Firm* — TraskBritt

(57) ABSTRACT

An application tip and method for dispensing a fluid into a hole, the tip having a hollow housing or body with an open end and a closed end, the open end configured to be removably attached to and in fluid communication with a fluid source, the closed end including a nozzle having at least one passage or fluid outlet opening.

20 Claims, 3 Drawing Sheets

(56) References Cited

U.S. PATENT DOCUMENTS

| | | | | |
|---|---|---|---|---|
| 2012/0114835 | A1* | 5/2012 | Belanger | 427/8 |
| 2012/0273115 | A1 | 11/2012 | Suzuki et al. | |

FOREIGN PATENT DOCUMENTS

| | | | |
|---|---|---|---|
| EP | 2361692 | A1 | 8/2011 |
| WO | 2005115635 | A1 | 12/2005 |

OTHER PUBLICATIONS

Semco® Fillet Nozzles, PPG Aerospace, [online], [retrieved on Aug. 21, 2013] Retrieved online from <http://www.ppg.com/coatings/aerospace/semcoappsys/semcosystems/semcopkgproducts/nozzlessmoothingtools/Pages/filletNozzles.aspx>, 2 pages.

Semco® Ribbon Nozzles, PPG Aerospace, [online], [retrieved on Aug. 21, 2013] Retrieved online from <http://www.ppg.com/coatings/aerospace/semcoappsys/semcosystems/semcopkgproducts/nozzlessmoothingtools/Pages/ribbonNozzles.aspx>, 2 pages.

Semco® Specialty Application Nozzles, Technical Data. PPG Industries Semco Packaging & Application Systems. [online] [retrieved on Aug. 21, 2013] Retrieved online from <http://www.ppg.com/coating/aerospace/semcoplg/semco_specialty_application_nozzels.pdf> 2 pages.

Semco® Standard Nozzles, PPG Aerospace, [online], [retrieved on Aug. 22, 2013] Retrieved online from <http://www.ppg.com/coatings/aerospace/semcoappsys/semcosystems/semcopkgproducts/nozzlessmoothingtools/Pages/standard_nozzles.aspx>, 2 pages.

International Search Report for International Application No. PCT/US2014/019364 dated Jun. 16, 2014, 5 pages.

International Written Opinion for International Application No. PCT/US2014/019364 dated Jun. 16, 2014, 7 pages.

* cited by examiner

APPLICATION TIPS INCLUDING A DISPENSING NOZZLE WITH ONE OR MORE DISPENSING PASSAGES EXTENDING ALONG A LENGTH THEREOF AND RELATED METHODS

STATEMENT REGARDING FEDERALLY SPONSORED RESEARCH OR DEVELOPMENT

Pursuant to United States Government Contract No. N00019-10-00002, the Government may have certain rights in this invention.

BACKGROUND

Many countersink fasteners used, for example, on airplane structures, require sealant to be applied to countersunk holes before the fastener is inserted. Sealing of the countersunk holes aid in keeping air and fluids from passing in and around the fasteners. The sealant application process is typically performed by hand.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, an application tip is provided. The tip includes a housing having a first end, a second end and an internal passage. The first end of the housing has an opening to the internal passage. The housing also has a dispensing nozzle extending from the second end of the housing, the dispensing nozzle includes a conical member that extends from the second end of the housing and a cylindrical member extending from the conical member, the cylindrical member terminates in a closed end. The dispensing nozzle has at least one dispensing passage that extends along a length of the conical member and the cylindrical member.

In another embodiment, an application tip is provided. The application tip includes a body having a first end, a second end and an internal passage. The first end is configured to be selectively coupled to a sealant cartridge to receive sealant in the internal passage. The tip has a dispensing nozzle extending from the second end of the body, the dispensing nozzle includes a conical member having a first end and a second end, the first end of the conical member extends from the second end of the body, and the conical member has a diameter that narrows as the conical member extends from the body. The tip further includes a cylindrical member extending from the second end of the conical member, the cylindrical member terminates in a closed end. The dispensing nozzle has at least one dispensing passage that extends a length of the conical member and a length of cylindrical member, and the at least one dispensing passage is configured to dispense sealant from the internal passage.

In still another embodiment, a method of using an application tip is provided. The method includes: inserting a dispensing nozzle of an application tip in a bore; activating a sealant cartridge that is in fluid communication with the application tip; rotating the dispensing nozzle within the bore to evenly dispense the sealant within a bore portion of the bore and a countersunk portion of the bore; and removing the dispensing tip from the bore.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Typical sealant application processes require an operator to use small dowels (e.g., wood) to apply sealant to a countersunk hole before installing a fastener. An embodiment of a sealant applicator assembly is designed to apply sealant directly from a sealant source such as a sealant cartridge or gun. The sealant applicator assembly further allows for a predetermined sealant amount to be dispensed and evenly coated on the inside surface of a countersunk hole. The above described features result in eliminating the time to transfer sealant from the sealant source to a tray and then from the tray to the dowel. Moreover, fewer materials are wasted during this process.

Figure 1:
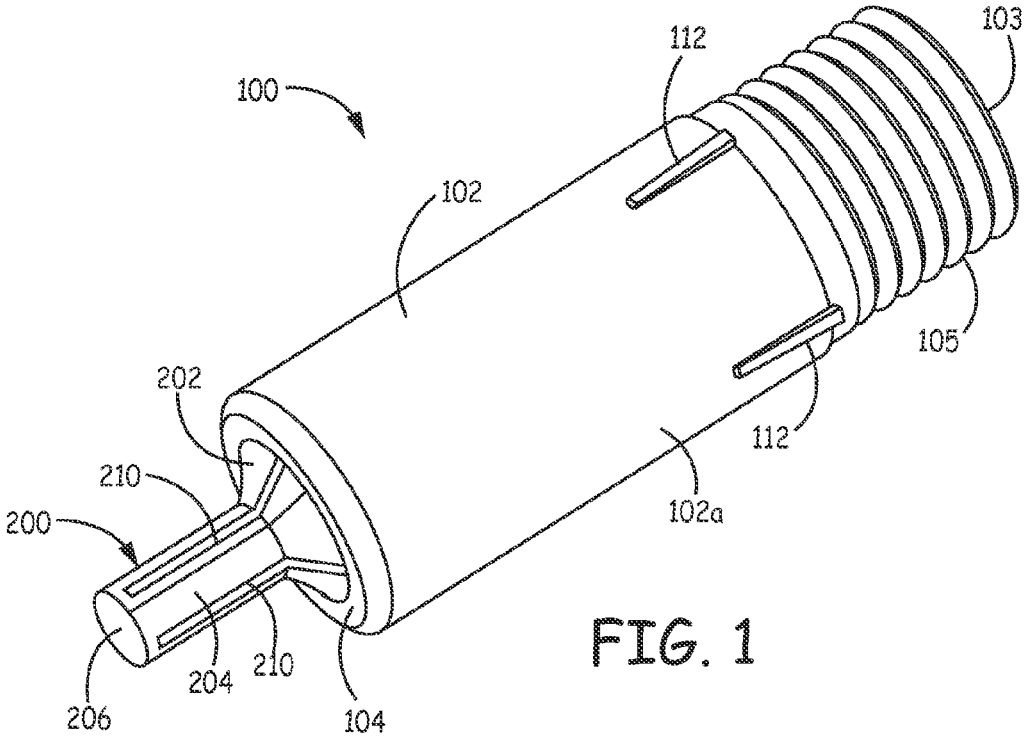
FIG. 1 is a perspective view of an embodiment of an application tip.

Embodiments of the present invention provide an application tip that allows for sealant to be evenly coated in the inside surface of a countersunk bore with a twist of an application gun. Referring to FIG. 1, an embodiment of an application tip 100 is illustrated. The application tip 100 includes a cylindrical body or housing 102 having a first end 103 and a second end 104. The first end 103 is open to an inner passage 130 (shown in FIG. 2). The body or housing 102 includes external threads 105 that are positioned proximate the first end 103. The threads 105 are used to selectively connect the application tip 100 to a sealant cartridge 300 as further described below. Desirably, any attaching mechanism that is required to engage or otherwise connect application tip 100 to a sealant source is contemplated.

Proximate the threads 105 are projection members 112 that extend from an outer surface 102*a* of the body 102. The projection members 112 provide grip when connecting and un-connecting the application tip 100 to and from a sealant cartridge 300 described below.

Figure 2:
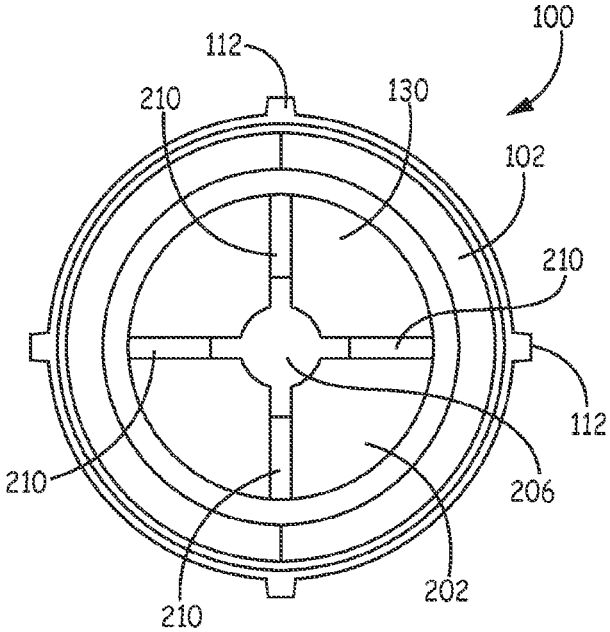
FIG. 2 is a top view of the application tip of FIG. 1.

Extending from the second end 104 of the application tip 100 is a dispensing nozzle 200. The dispensing nozzle 200 includes a conical member 202 that extends from the second end 104 of the body 102. The conical member 202 flares inward to negatively mirror the shape of a countersunk portion of a countersunk hole or bore. Moreover, the conical member 202 has a diameter that narrows as the conical member 202 extends from the second end 104 of the body 102. A cylindrical member 204 extends from the conical member 202 in a direction that is away from the body 102. The cylindrical member 204 has a shape to fit within a bore portion of a countersunk bore. The cylindrical member 204 terminates in a closed end 206. The dispensing nozzle 200 further includes at least one dispensing passage or fluid outlet openings 210. Moreover, the dispensing nozzle 200 preferably includes four equally spaced dispensing passages 210. Each dispensing passage 210 extends a length of the conical member 202 and a length of the cylindrical member 204. In one embodiment the dispensing passages or fluid outlet openings 210 are slots. The dispensing passages 210 provide a passage for sealant to exit the dispensing nozzle 200 during an application as discussed below. FIG. 2 illustrates a top view of the application tip 100. This view illustrates the inner passage 130, the closed end 206 of the dispensing nozzle 200 and the four equally spaced dispensing passages 210. This arrangement provides for sealant to be dispensed as a thin layer that evenly coats a bore portion of a bore and a countersunk portion of a countersunk bore or hole.

Figure 4:
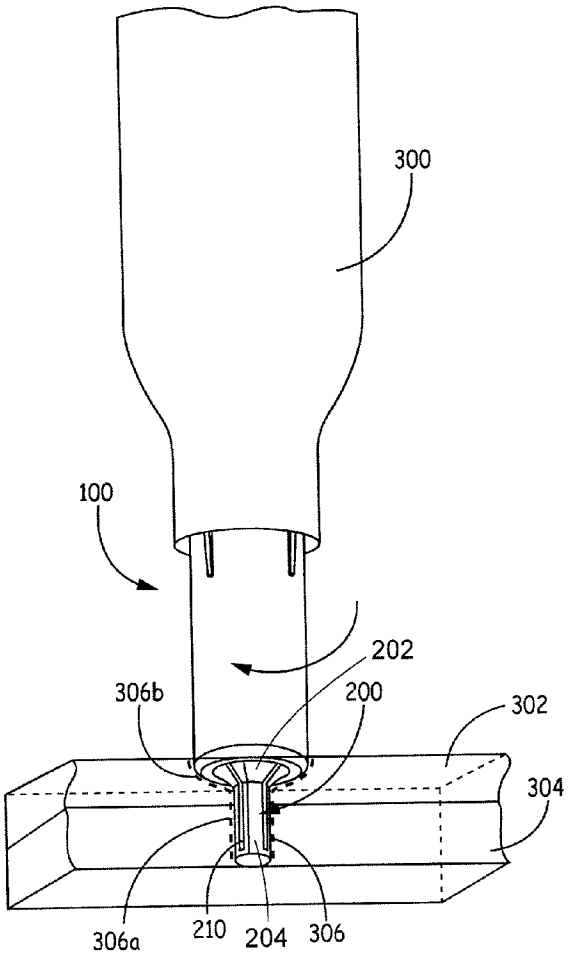
FIG. 4 is a side view of the application tip of FIG. 1 in use.
Figure 3:
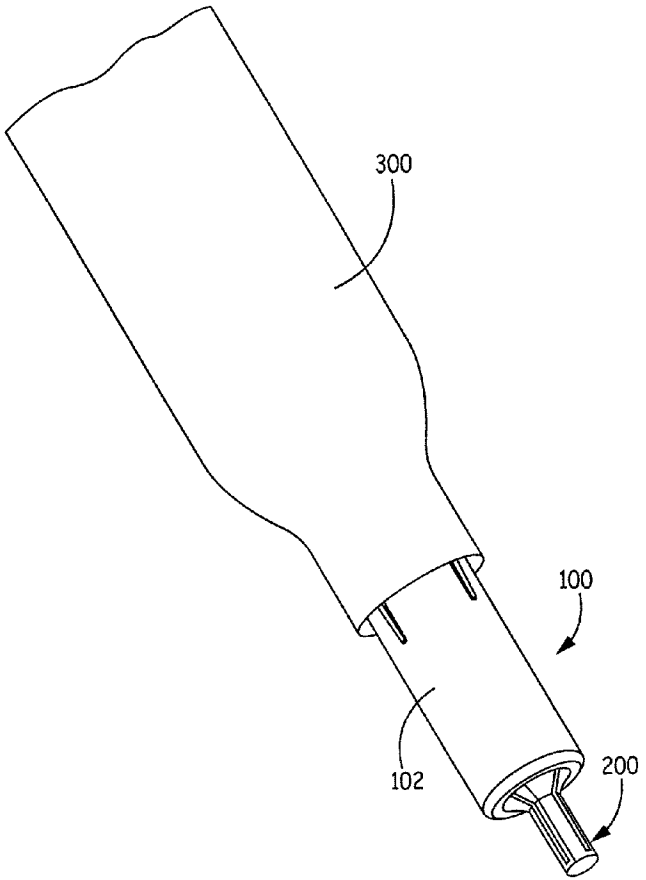
FIG. 3 is a side perspective view of the application tip of FIG. 1 coupled to a sealant cartridge.

FIG. 3 illustrates the application tip 100 coupled to a sealant cartridge 300 that contains sealant. The sealant cartridge 300, in this embodiment, includes inner threads (not visible) that threadably engage the external threads 105 of the application tip 100 (FIG. 1) to couple the application tip 100 to the sealant cartridge 300. Typically, an application gun (not shown) would be applied to the sealant cartridge 300 to activate the cartridge 300 to dispense sealant. FIG. 4 illustrates the application tip 100 in use. As illustrated, the dispensing nozzle 200 is inserted into a bore 306 in which a fastener (not shown) is to be received to couple a first structure 302 to a second structure 304. The countersunk bore 306 passes through the first and second structure 302 and 304. As FIG. 4 illustrates, the cylindrical member 204 of the dispensing nozzle 200 fits within the bore portion 306*a* of the bore 306 and the conical member 202 fits within the countersunk portion 306*b* of the bore 306. Different size bores will require different size dispensing nozzles 200. To dispense sealant, the sealant cartridge 300 is activated. This forces sealant (not shown) out of the dispensing nozzles 210. As the sealant is dispensed, the application tip 100 is rotated one quarter turn in one direction to evenly dispense sealant in the bore portion 306*a* and the countersunk portion 306*b* of the bore 306. If only three equally spaced dispensing passages 210 are present in the dispensing nozzle 200, the dispensing nozzle would need to be rotated one third a turn to dispense the sealant evenly. Moreover, if only two spaced dispensing passages 210 were present in the dispensing nozzle 200, the dispensing nozzle would need to be rotated one-half turn to dispense the sealant evenly, and the like. Hence, the number of dispensing passages determines the rotation needed to evenly spread the sealant in the bore.

Figure 5:
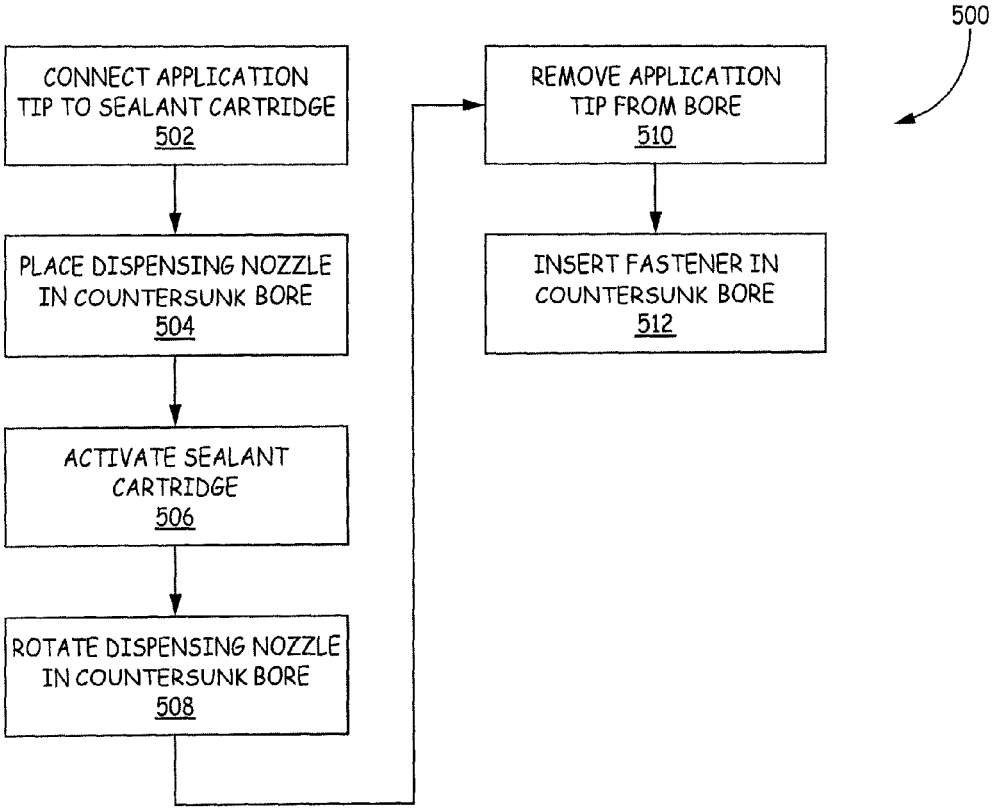
FIG. 5 is an application flow diagram of one embodiment of the present invention.

FIG. 5 illustrates an application flow diagram 500 of an embodiment. The process starts by attaching an application tip 100 to a sealant cartridge 300 (502). The dispensing nozzle 210 of the application tip 100 is then placed in a countersunk bore 306 (504). The sealant cartridge 300 is then activated (506). As discussed above, this is typically done with an application gun that forces out the sealant from the sealant cartridge 300 into the application tip 100 and out the dispensing passages 210. The application tip 100 is then rotated to evenly dispense the sealant within the bore 306 (508). Rotation of the application tip 100 would typically be accomplished by rotating the application gun. After rotation, the dispensing nozzle 200 of the application tip 100 is removed from the bore 306 (510). A fastener (not shown) is then fastened within the bore (512).

Application tip 100 may have, for example, a diameter of at least or about 0.3 to 0.6 inch or any range or value therebetween. Depending on the fastener and countersink to be sealed, other diameters for application tip 100 beyond those shown in FIG. 2 are possible. The diameter of dispensing nozzle 200 is dimensioned such that clearance between the diameter of application tip 100 and the diameter of the hole is such that it controls how much sealant is applied to the hole.

Application tip 100 is desirably dimensioned and configured to dispense metered amounts of sealant to form a continuous sealant ring over the countersunk hole. Application tip 100 desirably meters out an incremental sealant portion. The metered amount will be a function of several factors including application tip 100 length, the dispensing passage or opening length, size and shape. Desirably, application tip 100 is configured and dimensioned for attaching to commercially available sealant cartridges, for example, sealant cartridges available from Semco, Inc.

Application tip 100 can be made from any suitable material, such as, but not limited to, stainless steel or other acceptable metal or alloy. Other materials suitable for the application tip 100 include, but are not limited to, polyvinyl chloride (PVC), nylon, polyether ketone (PEEK), acrylonitrile butadiene styrene (ABS) and the like.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. An application tip, comprising:

a housing having a first end and a second end, the housing having an internal passage, the first end of the housing having an opening to the internal passage;

a dispensing nozzle extending from the second end of the housing, the dispensing nozzle including a conical member having an external surface and extending from the second end of the housing and a cylindrical member having a circumferential surface and extending from the conical member, the cylindrical member terminating in a closed end; and the dispensing nozzle having at least one dispensing passage that extends along a continuous length of the conical member and through the external surface of the conical member, to the cylindrical member, and along a length of the cylindrical member and through the circumferential surface of the cylindrical member.

2. The application tip of claim 1, wherein the housing has threads that are positioned proximate the first end of the housing that are configured to threadably attach the housing to a sealant source.

3. The application tip of claim 1, wherein the housing includes at least one projection member extending from an outer surface of the housing to aid in gripping the application tip.

4. The application tip of claim 1, wherein the at least one dispensing passage is a slot.

5. The application tip of claim 1, wherein the at least one dispensing passage is at least two evenly spaced openings.

6. The application tip of claim 1, wherein the conical member has a diameter that narrows as the conical member extends from the second end of the housing.

7. The application tip of claim 1, wherein the at least one dispensing passage is four evenly spaced openings.

8. An application tip, comprising:

a body having a first end, a second end and an internal passage, the first end configured to be selectively coupled to a sealant cartridge to receive sealant in the internal passage; and a dispensing nozzle extending from the second end of the body, the dispensing nozzle comprising:

a conical member having a first end, a second end, and an outer surface extending between the first end and the second end, the first end of the conical member extending from the second end of the body, the conical member having a diameter that narrows as the conical member extends from the body; and a cylindrical member having an outer surface and extending from the second end of the conical member, the cylindrical member terminating in a closed end, the dispensing nozzle having at least one dispensing passage that extends a length of the dispensing nozzle comprising a first length extending along the narrowing diameter of the conical member and through the outer surface of the conical member and a second length extending along the cylindrical member and through the outer surface of the cylindrical member, the at least one dispensing passage configured to dispense sealant from the internal passage.

9. The application tip of claim 8, further comprising the body having connecting threads positioned proximate the first end of the body to threadably connect the application tip to the sealant cartridge.

10. The application tip of claim 8, further comprising the body including at least one projection member extending from an outer surface of the body to aid in gripping the application tip.

11. The application tip of claim 8, wherein the at least one dispensing passage is at least two evenly spaced dispensing passages.

12. The application tip of claim 8, wherein the at least one dispensing passage is four evenly spaced dispensing passages.

13. The application tip of claim 8, wherein the at least one dispensing passage is a slot.

14. The application tip of claim 8, wherein the application tip has a length of 1 to 3 inches long.

15. The application tip of claim 8, wherein the dispensing nozzle has an outer diameter of 0.3 to about 0.9 inch.

16. A method of using an application tip, the method comprising:

inserting the dispensing nozzle of the application tip of claim 1 in a bore of a structure;

activating a fluid cartridge that is in fluid communication with the application tip;

rotating the dispensing nozzle within the bore to evenly dispense the fluid within a bore portion of the bore and a countersunk portion of the bore; and removing the dispensing nozzle from the bore.

17. The method of claim 16, wherein rotating the dispensing nozzle within the bore further comprises rotating the dispensing nozzle one quarter tum within the bore.

18. The method of claim 16, further comprising connecting the application tip to the fluid cartridge.

19. The method of claim 16, further comprising after removing the dispensing nozzle from the bore, inserting a fastener within the bore.

20. An application tip, comprising:

a housing having a proximal end, a distal end, and an internal passageway extending between the proximal end and the distal end, the proximal end of the housing having an opening to the internal passageway and configured to be coupled to a cartridge to receive fluid from the cartridge in the internal passageway; and a dispensing nozzle extending from the distal end of the housing and having a closed distal end, the dispensing nozzle comprising:

a conical portion having a proximal end extending from the distal end of the housing and a distal end;

an extension portion extending from the distal end of the conical member to the closed distal end of the dispensing nozzle; and a plurality of slots in a lateral sidewall of the dispensing nozzle in communication with the internal passageway of the housing, each of the plurality of slots extending along the conical portion and the extension portion of the dispensing nozzle and through an external surface of the conical portion and an external surface of the extension portion between the closed distal end of the dispensing nozzle and the distal end of the housing.

* * * * *

UNITED STATES PATENT AND TRADEMARK OFFICE

CERTIFICATE OF CORRECTION

PATENT NO. : 9,038,866 B2
APPLICATION NO. : 13/797639
DATED : May 26, 2015
INVENTOR(S) : Jacob L. Nelson et al.

It is certified that error appears in the above-identified patent and that said Letters Patent is hereby corrected as shown below:

On the title page:

In ITEM (71) Applicant: change "Alliant Techsystems Inc., Minneapolis, MN" to --Orbital ATK, Inc., Dulles, VA--

Signed and Sealed this
Twenty-seventh Day of October, 2015

Michelle K. Lee

Michelle K. Lee
*Director of the United States Patent and Trademark Office*